US011518180B2

(12) United States Patent
Ishii

(10) Patent No.: US 11,518,180 B2
(45) Date of Patent: Dec. 6, 2022

(54) IMAGING SYSTEM HAVING HEATING AREA DATA FOR A RECORDING MEDIUM

(71) Applicant: Satoki Ishii, Kanagawa (JP)

(72) Inventor: Satoki Ishii, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/368,569

(22) Filed: Jul. 6, 2021

(65) Prior Publication Data

US 2022/0016911 A1 Jan. 20, 2022

(30) Foreign Application Priority Data

Jul. 15, 2020 (JP) ..... JP2020-121372

(51) Int. Cl.
*B41J 11/00* (2006.01)
*D06P 5/30* (2006.01)
*B41J 3/407* (2006.01)

(52) U.S. Cl.
CPC ..... *B41J 11/00242* (2021.01); *B41J 3/4078* (2013.01); *D06P 5/30* (2013.01)

(58) Field of Classification Search
CPC ..... B41J 11/00242; B41J 3/4078; B41J 11/00244; D06P 5/30
See application file for complete search history.

(56) References Cited

U.S. PATENT DOCUMENTS

2018/0105979 A1* 4/2018 Matsumoto ..... F26B 23/04

FOREIGN PATENT DOCUMENTS

JP 2018-066097 4/2018
JP 2018-084013 5/2018

* cited by examiner

*Primary Examiner* — Bradley W Thies
(74) *Attorney, Agent, or Firm* — Duft & Bornsen, PC

(57) ABSTRACT

An imaging system includes a liquid discharge device, a heating device, and a cassette. In the imaging system, the cassette includes a holder to hold a recording medium and a storage device to store heating-area data indicating a heating area of the recording medium to be heated before an image is printed on the recording medium. Moreover, in the imaging system, the liquid discharge device includes a printing device to discharge liquid onto the recording medium held by the holder to print the image on the recording medium and a writing device to write liquid discharge region data to the storage device, the liquid discharge region data indicating a liquid discharge region of the recording medium onto which the liquid is discharged by the printing device. Further, in the imaging system, the heating device includes a heater to heat the heating area of the recording medium.

6 Claims, 7 Drawing Sheets

IMAGING SYSTEM HAVING HEATING AREA DATA FOR A RECORDING MEDIUM

CROSS-REFERENCE TO RELATED APPLICATION

This patent application is based on and claims priority pursuant to 35 U.S.C. § 119(a) to Japanese Patent Application No. 2020-121372, filed on Jul. 15, 2020, in the Japan Patent Office, the entire disclosure of which is hereby incorporated by reference herein.

BACKGROUND

Technical Field

Embodiments of the present disclosure relate to an imaging system.

Background Art

For garment printers each of which serves as imaging system and uses a cassette holding or fixing a garment such as a fabric that serves as a recording medium, some technologies have been developed that the cassette holding the garment to which liquid such as ink has been discharged by a liquid discharge device is set in a heating device as it is and the liquid discharged to the garment is dried to fix an image printed on the garment.

SUMMARY

Embodiments of the present disclosure described herein provide an imaging system includes a liquid discharge device, a heating device, and a cassette. In the imaging system, the cassette includes a holder configured to hold a recording medium and a storage device configured to store heating-area data indicating a heating area of the recording medium to be heated before an image is printed on the recording medium. Moreover, in the imaging system, the liquid discharge device includes a printing device configured to discharge liquid onto the recording medium held by the holder to print the image on the recording medium and a writing device configured to write liquid discharge region data to the storage device, the liquid discharge region data indicating a liquid discharge region of the recording medium onto which the liquid is discharged by the printing device. Further, in the imaging system, the heating device includes a heater configured to heat the heating area of the recording medium, a reading device configured to read the heating-area data and the liquid discharge region data from the storage device, and a controller configured to cause the heater to heat the heating area indicated by the heating-area data on the recording medium held by the holder when the image is not yet printed on the recording medium and cause the heater to heat the liquid discharge region indicated by the liquid discharge region data on the recording medium held by the holder when the image has been printed on the recording medium.

BRIEF DESCRIPTION OF THE DRAWINGS

A more complete appreciation of embodiments and the many attendant advantages thereof will be readily obtained as the same becomes better understood by reference to the following detailed description when considered in connection with the accompanying drawings.

Figure 1:
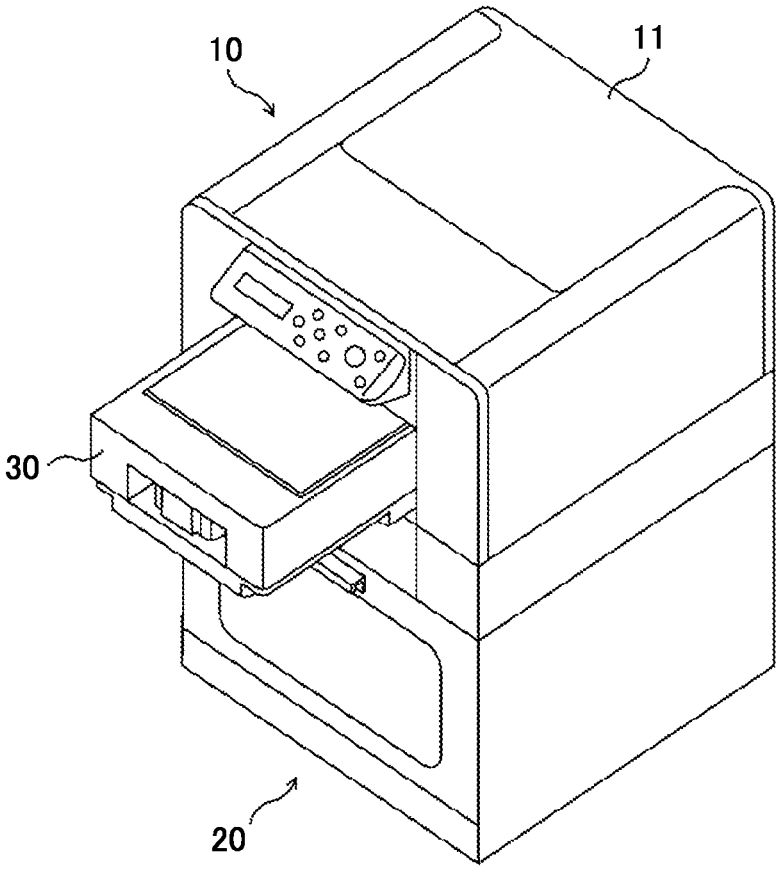
FIG. 1 is a diagram illustrating a configuration or structure of an imaging system according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that have the same structure, operate in a similar manner, and achieve a similar result.

An imaging system according to an embodiment of the present disclosure is described below in detail with reference to the accompanying drawings.

FIG. 1 is a diagram illustrating a configuration or structure of the imaging system according to the present embodiment.

The imaging system as illustrated in FIG. 1 is a system in which an image is printed on a recording medium such as a fabric, which may be referred to as a garment. As illustrated in FIG. 1, the imaging system according to the present embodiment includes a printing apparatus 10 that serves as a liquid discharge device, a heating device 20, and a cassette 30.

The printing apparatus 10 is an apparatus in which liquid such as ink is ejected onto a recording medium such as a fabric and an image is printed on a recording medium. More specifically, the printing apparatus 10 includes a main structural frame 11, a stage on which the cassette 30 that holds a recording medium is removably held, and a recording head 46 that serves as a printing device and discharge liquid to print an image on the recording medium stored in the cassette 30 held by the stage.

The heating device 20 heats the recording medium held on the cassette 30. The cassette 30 is removably insertable into the printing apparatus 10 and the heating device 20, and is provided with a holder that holds the recording medium.

Figure 2:
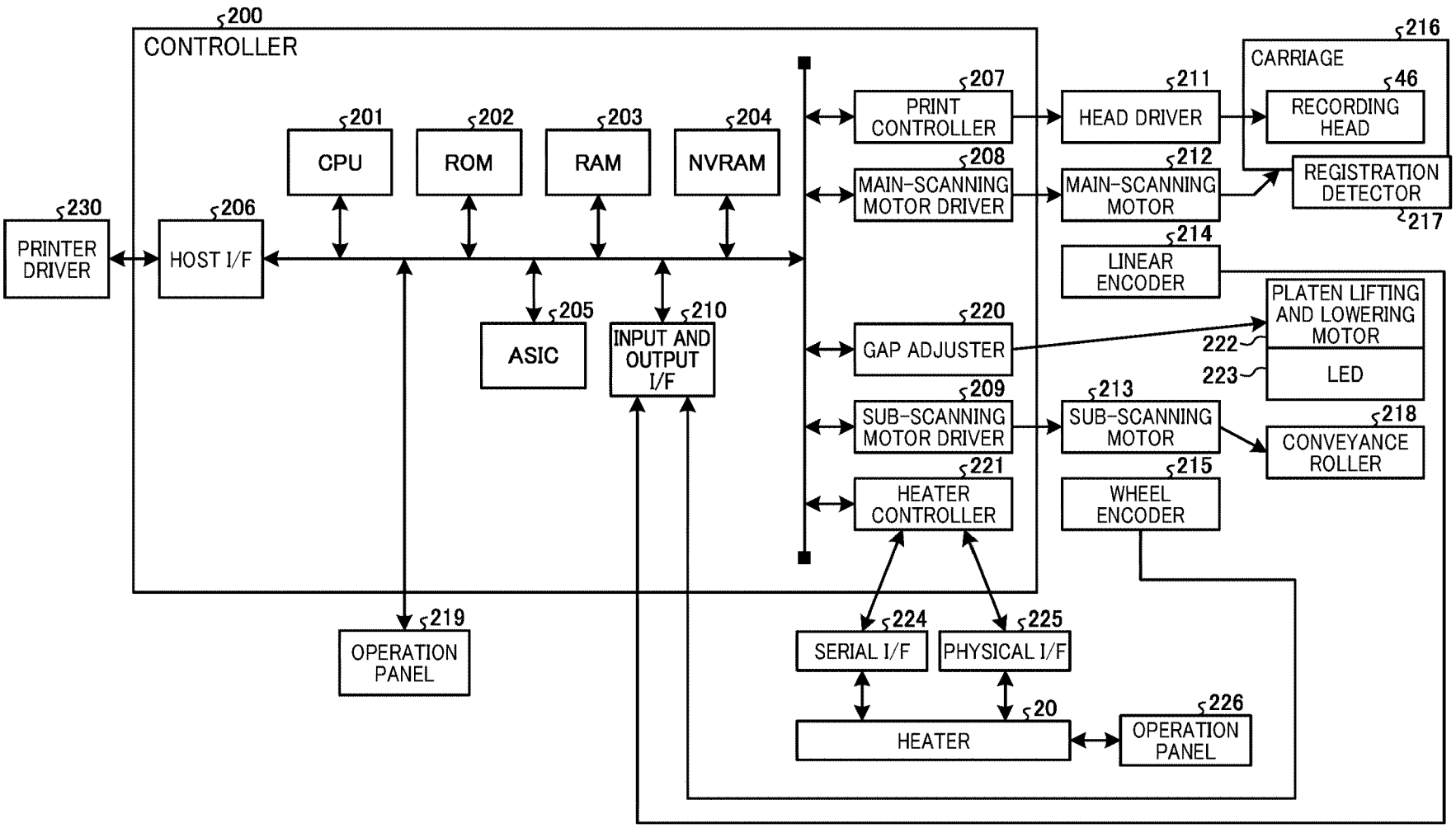
FIG. 2 is a diagram illustrating a hardware configuration of a controller of an imaging system according to an embodiment of the present disclosure.

FIG. 2 is a diagram illustrating a hardware configuration of the controller 200 of the imaging system according to the present embodiment.

The controller 200 of the imaging system according to the present embodiment controls the overall operation of the imaging system, and as illustrated in FIG. 2, includes a central processing unit (CPU) 201, a read only memory 202, a random access memory (RAM) 203, a non-volatile random access memory (NVRAM) 204, and an application-specific integrated circuit (ASIC) 205.

The CPU 201 according to the present embodiment controls the entirety of the imaging system. More specifically, the CPU 201 controls, for example, the conveying operation of the cassette 30 and the moving operation of the printing device. The ROM 202 according to the present embodiment stores programs to be executed by the CPU 201 or other various kinds of fixed data. The RAM 203 according to the present embodiment provides a work area for the CPU 201, and stores, for example, the image data on a temporary basis. The NVRAM 204 is a storage device that can retain data or the like even while the power of the imaging system is turned off, and the data or the like that is stored in the NVRAM 204 is rewritable. For example, the ASIC 205 performs image processing on image data. In such image processing on the image data, various kinds of signal processing, rearranging, or sequence control are done. Moreover, the ASIC 205 processes other various kinds of input signal or output signal used to control the entirety of the imaging system.

Moreover, as illustrated in FIG. 2, the controller 200 includes a host interface (I/F) 206, a print controller 207, a main-scanning motor driver 208, a sub-scanning motor driver 209, and an input and output interface (I/F) 210.

The host interface 206 receives print data or the like generated by a printer driver 230 mounted on a host such as an data processor such as a personal computer (PC), an image reader such as an image scanner, or an imaging device such as a digital camera via a cable or a network. The network may be a wired network or a wireless network.

The printer driver 230 generates image data or dot pattern data that corresponds to one line of the printing device(46), and transmits the print data that includes the dot pattern data to the host interface 206. The generation of the dot pattern data is not limited to the generation by the printer driver 230, and the dot pattern data may be generated using the font data that stored in the ROM 202 in advance.

The host interface 206 includes a receive data buffer that stores, for example, received print data. The CPU 201 reads the print data from the receive data buffer, and analyzes the read print data. Moreover, the CPU 201 performs, for example, image processing, data rearrangement, and sequence control where appropriate using the ASIC 205, and transfers the processed data to the print controller 207.

The print controller 207 drives the printing device 46 at a prescribed timing using the transferred data. Moreover, the print controller 207 generates a drive waveform and output image data for selectively driving the pressure generator of the printing device and various kinds of data associated with the image data to the head driver 211. The drive waveform is a rectangular wave signal composed of one or more driving pulses, and the print controller 207 includes a drive waveform generation unit in order to generate such a drive waveform.

The driving waveform generation unit of the print controller 207 includes a digital-to-analog (D/A) convertor and an amplifier. The driving waveform generation unit performs digital-to-analog conversion on the pattern data of driving pulse, which is stored in the ROM 202 and read by the CPU 201, to generate a driving waveform including one or more driving pulses.

The head driver 211 drives the printing device by selectively applying driving pulses to the pressure generator of the printing device based on the dot pattern data that is input in series. The head driver 211 includes, for example, a shift driver, a latch circuit, a level converter or level shifter, and a switching unit or analog switch array. The shift driver receives, for example, a clock signal and serial data that is image data. The latch circuit latches a register value of the shift register with a latch signal. The level shifter changes the level of the output value of the latch circuit. The analog switch array performs turning on and turning off control according to the level changed by the level shifter. The head driver 211 performs turning on and turning off control as described above to apply a predetermined driving pulse included in the drive waveform to the pressure generator of the printing device in a selective manner.

The main-scanning motor driver 208 according to the present embodiment drives the main-scanning motor 212, and the sub-scanning motor driver 209 according to the present embodiment drives the sub-scanning motor 213. The input and output interface 210 accepts the pulses detected by a linear encoder 214 or a wheel encoder 215 or the signals detected by other various kinds of sensors or detectors.

The carriage 216 that is provided with a printing device includes a registration detector 217 that detects the position of the printing device, i.e., the recording head 46, and the main-scanning motor 212 moves the carriage 216 in the main scanning direction based on the position detected by the registration detector 217. The sub-scanning motor 213 drives the conveyance roller 218 to move the cassette 30 in the sub-scanning direction.

The controller 200 is coupled to an operation panel 219 to accept input of data such as a print instruction and print setting data and to display data such as a message indicating the completion of printing and a message indicating the occurrence of an error. Further, the controller 200 includes a gap adjuster 220 and a heater controller 221 that serves as a controller. The gap adjuster 220 controls driving of a platen lifting and lowering motor 222 that vertically drives the platen based on the height position of the platen detected by a light emitting diode (LED) sensor 223, to adjust the height of the platen. The heater controller 221 partly serves as the controller and controls the heating device 20 and the data transmission and data reception between the heating device 20. In the present embodiment, the heater controller 221 is provided outside the heating device 20. However, no limitation is indicated thereby, and the heater controller 221 may be provided inside the heating device 20.

A serial interface (I/F) 224 and a physical interface (I/F) 225 are disposed between the controller 200 and the heating device 20, and the heating device 20 is provided with an operation panel 226. The power of the heater controller 221 is turned on through the physical interface 225 or the operation panel 226, and the data is exchanged between the controller 200 and the heating device 20 through the serial interface 224 such as RSR-232-C.

Figure 3:
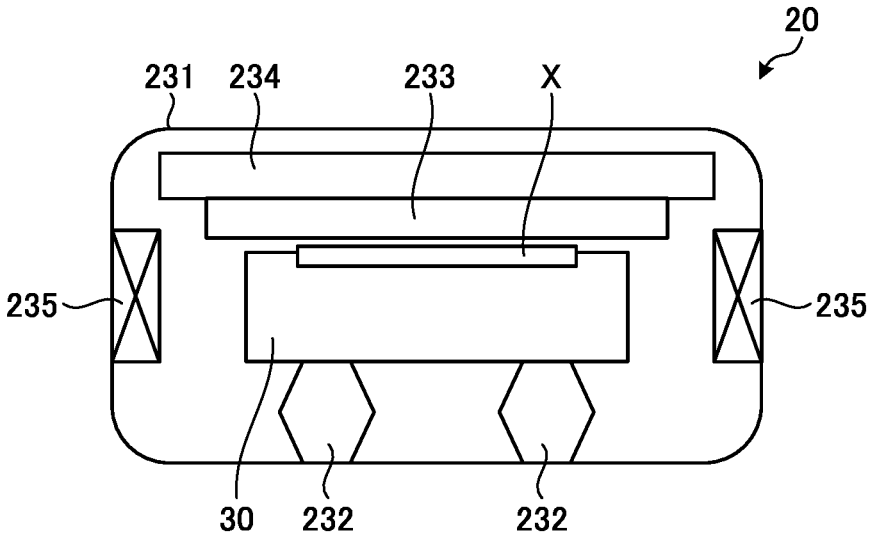
FIG. 3 is a diagram illustrating a configuration of a heating device according to an embodiment of the present disclosure.

FIG. 3 is a diagram illustrating a configuration of the heating device 20 according to the present embodiment.

As illustrated in FIG. 2, the heating device 20 has a main structural frame 231, and a receiver 232 and a heater 233 are disposed inside the main structural frame 231.

The receiver 232 is a member on which the cassette 30 having a tray that holds a recording medium X such as a fabric to which an image is formed or printed may be placed in a detachable manner. The tray of the cassette 30 serves as a holder and may be referred to as a fabric holding member in the following description. The receiver 232 moves the cassette 30 up and down relative to the heater 233 by moving the cassette 30 back and forth relative to the heater 233. The cassette 30 can also be attached to and detached from the printing apparatus 10 while holding the recording medium X thereon.

The heater 233 heats the recording medium X held by the cassette 30 mounted on the receiver 232 in contact with or without contacting the recording medium X. It is desired that the heater 233 be, for example, a mica heater and a silicon rubber heater.

As the surface of the silicon rubber heater is made of resilient rubber, it is desirable that a flat plate such as a metal sheet be disposed on the surface of the silicon rubber heater that heats the recording medium X. Moreover, it is desirable that the surface of such a flat plate on the recording medium X side be covered with a fluoroplastic material or a water repellent in order to prevent adhesion of liquid on the recording medium X.

In the main structural frame 231, an insulator 234 is arranged above the heater 233. Further, in the main structural frame 231, a pair of fans 235 are provided on both sides of the heater 233.

The flow of the operation of heating the recording medium X held on the cassette 30 by the heating device 20 will be described below.

Firstly, the recording medium X on which an image is printed by the printing apparatus 10 is held on the cassette 30. Secondly, the cassette 30 is mounted on the receiver 232 of the heating device 20. The heating device 20 lifts up the receiver 232 to press the recording medium X against the heater 233 at a predetermined degree of pressure. In so doing, the heating device 20 causes the heater 233 to heat up to a predetermined temperature to heat the recording medium X that is pressed against the heater 233.

The heating device 20 heats the recording medium X by the heater 233 for a predetermined length of time, and then lowers the receiver 232 to separate the recording medium X from the heater 233. As a result, the cassette 30 can be taken out from the heating device 20 while holding the recording medium X thereon. It is desirable that the recording medium X be given or sprayed with atomized water before being heated by the heater 233.

Subsequently, once the cassette 30 is inserted into the printing apparatus 10, the printing apparatus 10 starts printing an image on the recording medium X. When the printing of the image on the recording medium X by the printing apparatus 10 is completed, the cassette 30 that holds the recording medium X thereon is taken out from the printing apparatus 10 and mounted again on the receiver 232 of the heating device 20.

The heating device 20 lifts up the receiver 232 to bring the recording medium X close to the heater 233. Subsequently, the heating device 20 uses the heater 233 to heat the recording medium X held on the cassette 30. In so doing, the heating device 20 heats the recording medium X without pressing the recording medium X against the heater 233. In other words, the heating device 20 heats the recording medium X in a contactless manner. Accordingly, the adhesion of dirt or stain to the printing surface of the recording medium X and the possible damage on the recording medium X can be reduced. However, no limitation is indicated thereby, and the heating device 20 may heat the recording medium X while the recording medium X is being pressed against the heater 233 with a weak force. In other words, the heating device 20 may heat the recording medium X while the recording medium X is being brought into contact with the heater 233.

After the recording medium X is heated by the heater 233 for a predetermined length of time, the heating device 20 lowers the receiver 232 so that the cassette 30 can be taken out from the heating device 20. The movement of the receiver 232 relative to the heater 233 may be performed automatically, or may be performed manually.

As described above, the cassette 30 that can be attached to the printing apparatus 10 can also be attached to the heating device 20 as it is. Due to such a configuration, the recording medium X can be heated or an image can be printed on the recording medium X while the recording medium X is held in the cassette 30. Accordingly, the processability of the recording medium X or the efficiency of the heating procedure of the recording medium X can be improved. Moreover, even if the cassette 30 on which the recording medium X is held is carried, the wrinkles or grains of the recording medium X or the disturbance of the printing surface due to overlapping of a portion of the recording medium X can be reduced. Accordingly, the processability of printing an image on the recording medium X and the workability heating the recording medium X can further be improved.

Figure 4:
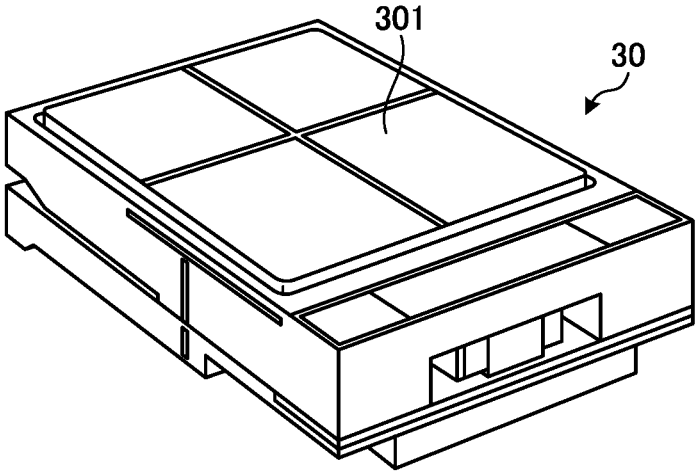
FIG. 4 is a perspective view of a cassette that is insertable into a printing apparatus and a heating device and is used to print an image of A4 size, according to an embodiment of the present disclosure.

FIG. 4 is a perspective view of the cassette 30 that is insertable into the printing apparatus 10 and the heating device 20 and is used to print an image of A4 size, according to the present embodiment.

Figure 5:
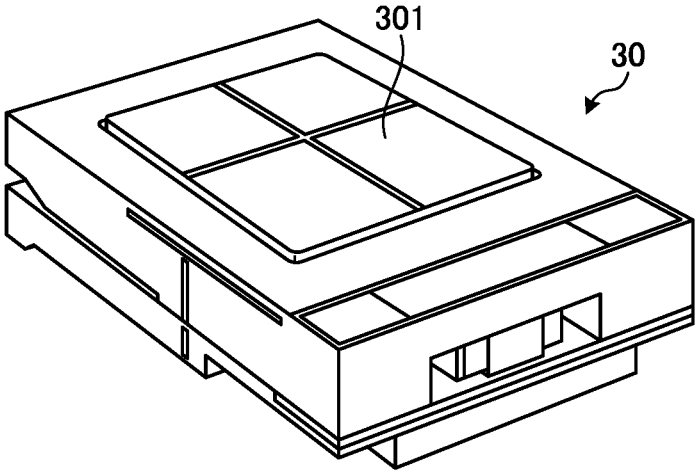
FIG. 5 is a perspective view of a cassette that is insertable into a printing apparatus and a heating device and is used to print an image of A5 size, according to an embodiment of the present disclosure.

FIG. 5 is a perspective view of the cassette 30 that is insertable into the printing apparatus 10 and the heating device 20 and is used to print an image of A5 size, according to the present embodiment.

Figure 6:
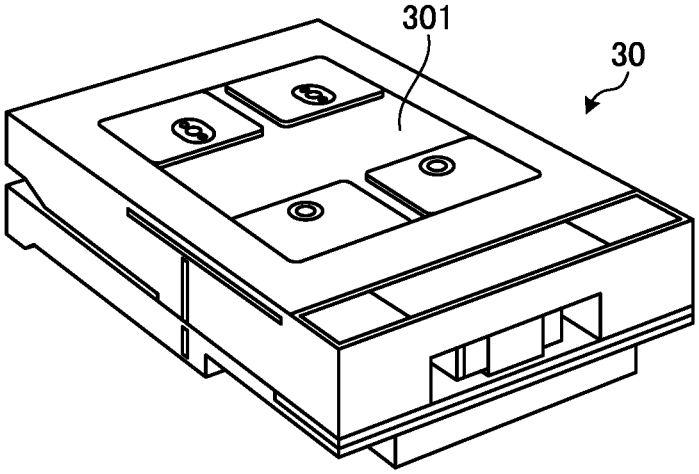
FIG. 6 is a perspective view of a cassette that is insertable into a printing apparatus and a heating device and is used to print an image on socks, according to an embodiment of the present disclosure.

FIG. 6 is a perspective view of the cassette 30 that is insertable into the printing apparatus 10 and the heating device 20 and is used to print an image on socks, according to the present embodiment.

The shape of the cassette 30 according to the present embodiment will be described below with reference to FIG. 4, FIG. 5, and FIG. 6.

The cassette 30 that is used to print an image of A4 size as illustrated in FIG. 4, the cassette 30 that is used to print an image of A5 size as illustrated in FIG. 5, and the cassette 30 that is used to print an image on socks as illustrated in FIG. 6 can be attached to and detached from the printing apparatus 10 and the heating device 20 according to the present embodiment. The cassette 30 as illustrated in FIG. 4, FIG. 5, and FIG. 6 can hold the recording medium such as fabric in a region indicated by reference sign 301.

Figure 7:
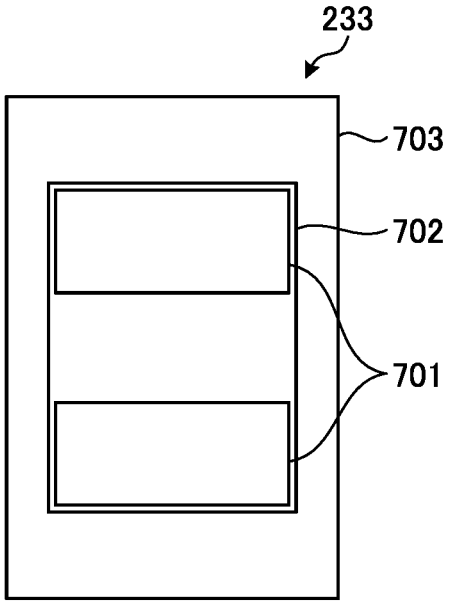
FIG. 7 is a diagram illustrating a configuration of a heater provided for a heating device according to an embodiment of the present disclosure.

FIG. 7 is a diagram illustrating a configuration of the heater 233 provided for the heating device 20 according to the present embodiment.

In the present embodiment, as illustrated in FIG. 7, the heater 233 includes a plurality of heating plates 701 to 703. The heating plate 701 is a heating plate used to heat socks as an example of the recording medium. The heating plate 702 is a heating plate used to heat the recording medium of A5 size. The heating plate 703 is a heating plate used to heat the recording medium of A4 size.

The heater controller 221 changes the heating plate to generate heat among the multiple heating plates 701 to 703 according to the type of cassette of the cassette 30 attached to the heating device 20. More specifically, when the cassette 30 used to print an image on socks is mounted, the heater controller 221 causes the heating plate 701 among the multiple heating plates 701 to 703 to generate heat to heat the recording medium. When the cassette 30 used to print an image of A5 size is mounted, the heater controller 221 causes the heating plate 702 to among the multiple heating plates 701 to 703 generate heat to heat the recording medium. When the cassette 30 used to print an image of A4 size is mounted, the heater controller 221 causes the heating plate 703 to generate heat to heat the recording medium.

Figure 8:
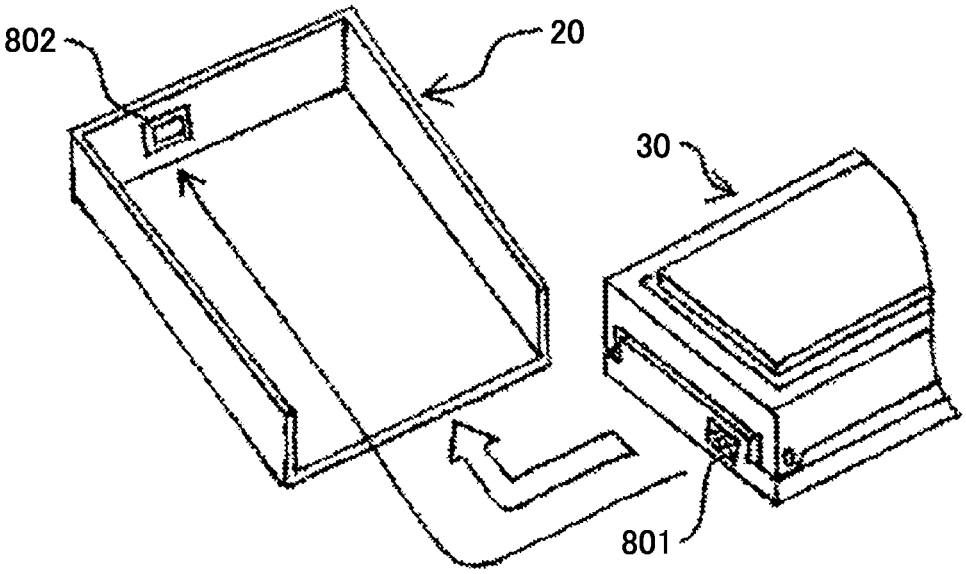
FIG. 8 is a diagram illustrating how a cassette is installed with a storage device, according to an embodiment of the present disclosure.

FIG. 8 is a diagram illustrating how the cassette 30 is installed with a storage device 801, according to the present embodiment.

In the present embodiment, as illustrated in FIG. 8, the cassette 30 includes a storage device 801 configured by a nonvolatile memory such as a hard disk drive (HDD) or a solid state drive (SSD). The storage device 801 stores heating-area data. The term "heating-area data" in the present embodiment indicates a heating area of a recording medium that is to be heated before an image is printed on the recording medium. In the present embodiment, the heating-area data is data used to specify the broadest area in which an image can be printed on the recording medium, and includes, for example, the type of cassette of the cassette 30. In the present embodiment, the heating area is different for each type of cassette of the cassette 30. For this reason, the heating-area data indicates a different heating area for each type of cassette of the cassette 30.

The storage device 801 is arranged at a position such that the heating device 20 can read, for example, the heating-area data and the liquid discharge region data, as will be described later, that are stored in the storage device 801 while the cassette 30 is attached to the heating device 20, and is arranged at a position such that the cassette 30 can write the liquid discharge region data in the storage device 801 when the cassette 30 is attached to the printing apparatus 10.

In the present embodiment, the liquid discharge region data is data used to specify a liquid discharge region of the recording medium in which an image is printed by the printing apparatus 10. In the present embodiment, the liquid discharge region data is data indicating the size of an image printed on the recording medium. For example, the liquid discharge region data indicates the size of socks, the A5 size, and the A4 size.

For example, as illustrated in FIG. 8, it is desired that the storage device 801 be arranged at a portion so as to be insertable into the printing apparatus 10 when the cassette 30 is attached to the printing apparatus 10, and it is desired that the storage device 801 be arranged at a portion so as to be insertable into the heating device 20 when the cassette 30 is attached to the heating device 20.

In the present embodiment, the storage device 801 is configured by a nonvolatile memory such as an HDD or an SSD, and stores various kinds of data such as the heating-area data and the liquid discharge region data. However, no limitation is indicated thereby, and various kinds of data such as the heating-area data and the liquid discharge region data may be recorded by a physical mechanism. For example, the storage device 801 may be a pawl or so-called ratchet that operates in response to the heating-area data and the liquid discharge region data.

The heating device 20 includes a reading and writing device 802 that can perform writing and reading various kinds of data such as the heating-area data and the liquid discharge region data to and from the storage device 801. The reading and writing device 802 can read and write various kinds of data from and to the storage device 801 when the cassette 30 is attached to the heating device 20. In the present embodiment, the heating device 20 includes the reading and writing device 802 that can perform both reading and writing of various kinds of data from and to the storage device 801. However, no limitation is indicated thereby, and the heating device 20 is satisfactory as long as it includes at least a reading device capable of reading various kinds of data from the storage device 801.

In a similar manner to the heating device 20, it is assumed in the present embodiment that the printing apparatus 10 also has a reading and writing device that can perform writing and reading various kinds of data such as the liquid discharge region data to and from the storage device 801. In the present embodiment, the reading and writing device of the printing apparatus 10 can read and write various kinds of data from and to the storage device 801 when the cassette 30 is attached to the printing apparatus 10. In the present embodiment, the printing apparatus 10 includes the reading and writing device that can perform both reading and writing of various kinds of data from and to the storage device 801. However, no limitation is indicated thereby, and the printing apparatus 10 is satisfactory as long as it includes at least a writing device capable of writing various kinds of data from the storage device 801.

Once the cassette 30 is attached to the heating device 20, the heater controller 221 causes the reading and writing device 802 to read the heating-area data or the liquid discharge region data from the storage device 801 of the attached cassette 30. Then, the heater controller 221 causes the heater 233 to heat the recording medium X held by the cassette 30. In particular, the heating area of the recording medium X specified by the heating-area data or the liquid discharge region of the recording medium X specified by the liquid discharge region data are heated.

Figure 9:
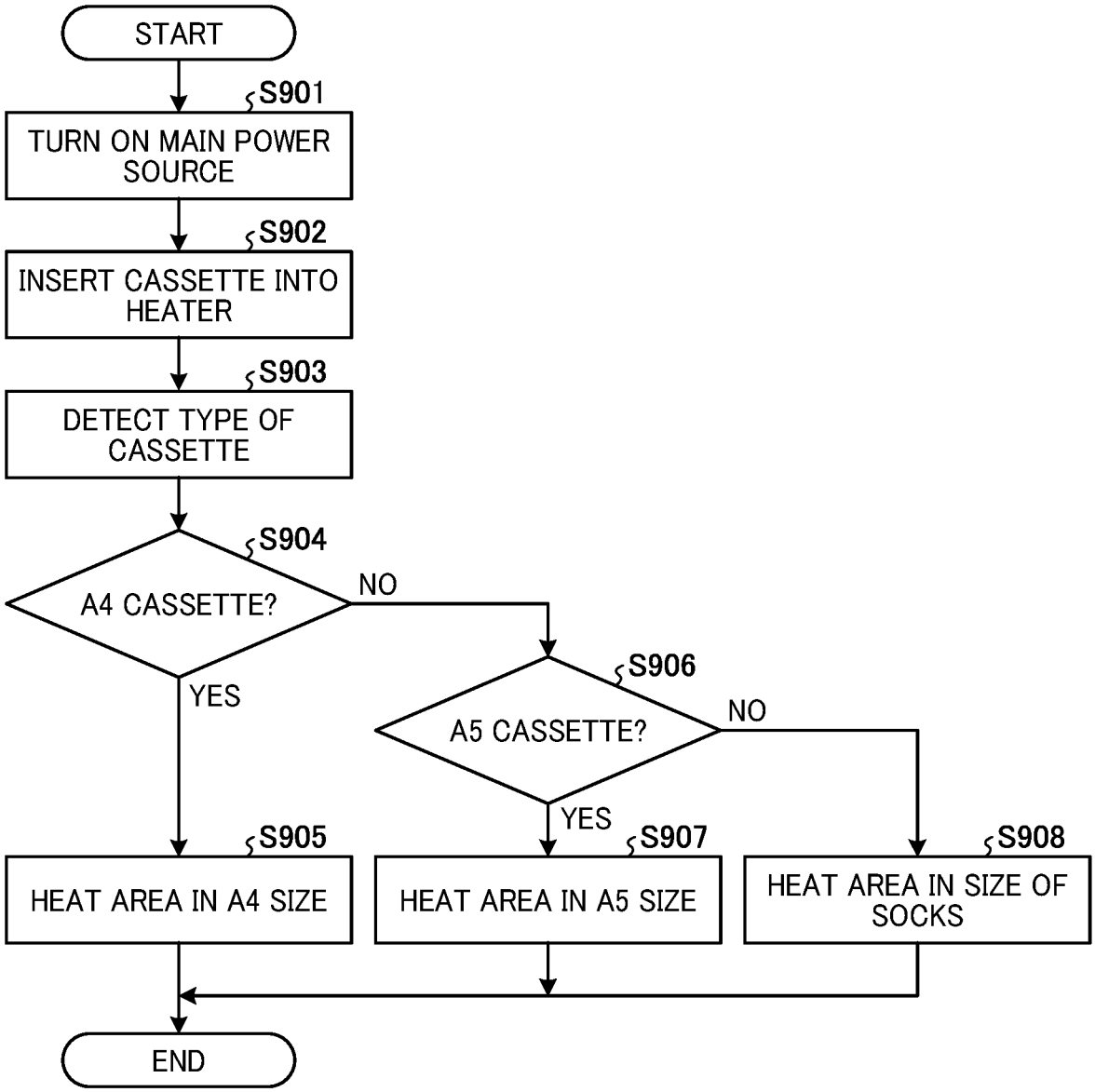
FIG. 9 is a flowchart displaying how a recording medium on which an image is not-yet printed is heated by a heating device, according to an embodiment of the present disclosure.

FIG. 9 is a flowchart displaying how a recording medium on which an image is not-yet printed is heated by the heating device, according to the present embodiment.

In a step S901, the power is turned on. After the power is turned on, in a step S902, the cassette 30 that holds the recording medium on which an image is not yet printed is attached to the heating device 20. In a step S903, the heater controller 221 causes the reading and writing device 802 to reads the heating-area data such as the type of cassette of the cassette 30 from the storage device 801 provided for the cassette 30.

Subsequently, in a step S904, the heater controller 221 determines whether the cassette 30 attached to the heating device 20 is an A4 cassette, i.e., the cassette 30 used to print an image of A4 size, based on the read heating-area data.

When it is determined that the cassette 30 attached to the heating device 20 is an A4 cassette, i.e., the cassette 30 used to print an image of A4 size ("YES" in the step S904), in a step S905, the heater controller 221 heats the heating area of A4 size through the heating plate 703 of the heater 233.

On the other hand, when it is determined that the cassette 30 attached to the heating device 20 is not the cassette 30 used to print an image of A4 size ("NO" in the step S904), in a step S906, the heater controller 221 determines whether the cassette 30 attached to the heating device 20 is an A5 cassette, i.e., the cassette 30 used to print an image of A5 size, based on the heating-area data.

When it is determined that the cassette 30 attached to the heating device 20 is an A5 cassette, i.e., the cassette 30 used to print an image of A5 size ("YES" in the step S906), in a step S907, the heater controller 221 heats the heating area of A5 size through the heating plate 702 of the heater 233.

On the other hand, when it is determined that the cassette 30 attached to the heating device 20 is not an A5 cassette, i.e., the cassette 30 used to print an image of A5 size ("NO" in the step S906), in a step S908, the heater controller 221 heats the heating area of socks through the heating plate 701 of the heater 233.

In other words, the heater controller 221 cause the heater 233 to heat the heating area indicated by the heating-area data on the recording medium held by the fabric holding member of the cassette 30 when an image is not yet printed on the recording medium.

Figure 10:
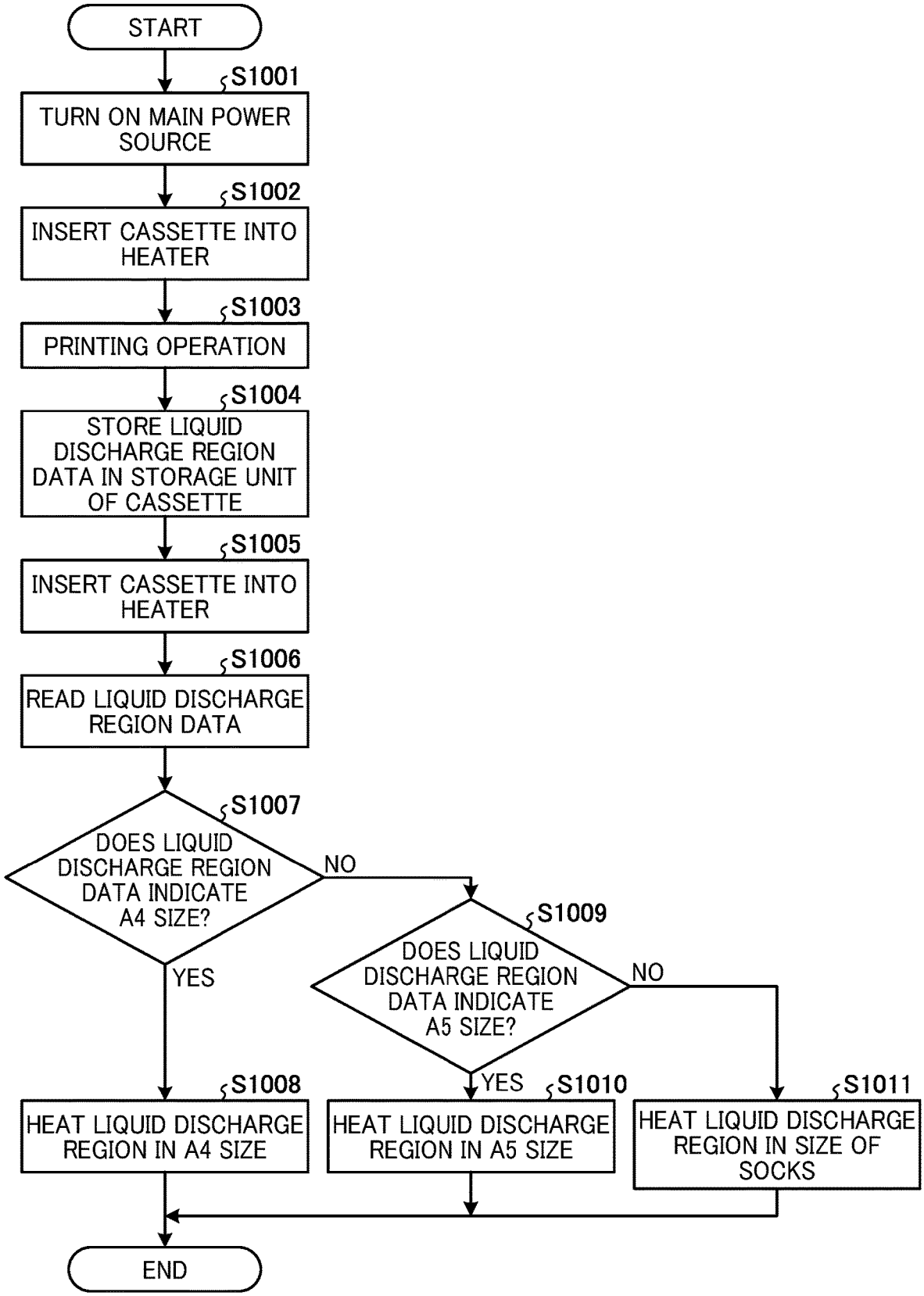
FIG. 10 is a flowchart displaying how a recording medium on which an image has been printed is heated by a heating device, according to an embodiment of the present disclosure.

FIG. 10 is a flowchart displaying how a recording medium X on which an image has been printed is heated by the heating device 20, according to the present embodiment.

In a step S1001, the power is turned on. After the power is turned on, in a step S1002, the cassette 30 that holds the recording medium that has been heated by the heating device 20 is attached to the printing apparatus 10. Then, in a step S1003, the print controller 207 performs image printing operation on the recording medium held by the cassette 30. Subsequently, in a step S1004, the reading and writing device of the printing apparatus 10 writes the liquid discharge region data in the storage device 801 provided for the cassette 30.

In a step S1005, the cassette 30 that holds the recording medium on which an image has been printed is attached to the heating device 20. Subsequently, in a step S1006, the heater controller 221 causes the reading and writing device 802 to read the liquid discharge region data from the storage device 801 of the attached cassette 30.

Then, in a step S1007, the heater controller 221 determines whether the liquid discharge region data indicates the A4 size. When it is determined that the liquid discharge region data indicates the A4 size ("YES" in the step S1007), in a step S1008, the heater controller 221 causes the heater 233 to heat the liquid discharge region of A4 size through the heating plate 703.

On the other hand, when it is determined that the print data does not indicate the A4 size ("NO" in the step S1007), in a step S1009, the heater controller 221 determines whether the liquid discharge region data indicates the A5 size. When it is determined that the liquid discharge region data indicates the A5 size ("YES" in the step S1009), in a step S1010, the heater controller 221 causes the heater 233 to heat the liquid discharge region of A5 size through the heating plate 702.

On the other hand, when it is determined that the liquid discharge region data does not indicate the A5 size ("NO" in the step S1009), in a step S1011, the heater controller 221 causes the heater 233 to heat the liquid discharge region of socks size through the heating plate 701.

In other words, the heater controller 221 cause the heater 233 to heat the liquid discharge region indicated by the liquid discharge region data on the recording medium held by the fabric holding member of the cassette 30 when an image has been printed on the recording medium.

As described above, with the image processing system according to the present embodiment, the region to be heated by the heater 233 on the recording medium can be switched between the ironing operation before an image is printed on the recording medium and the drying operation after an image is printed on the recording medium, based on the heating-area data and the liquid discharge region data. In other words, the region to be heated by the heating device 20 can be changed regardless of the printing state of the recording medium, based on the heating-area data and the liquid discharge region data. As a result, the power consumption due to the heating device 20 can be reduced. For example, even if the recording medium to be dried is small, the electric power that is used to heat the recording medium can effectively be used.

In the embodiment as described above, the image forming apparatus according to an embodiment of the present disclosure is applied to a multifunction printer or multifunction peripheral (MFP) that has at least two of a photocopying function, a printing function, a scanning function, and a facsimile (FAX) function. However, no limitation is indicated thereby, and the image forming apparatus according to an embodiment of the present disclosure may be applied to any image forming apparatus such as a copier, a printer, a scanner, and a facsimile (FAX).

Note that numerous additional modifications and variations are possible in light of the above teachings. It is therefore to be understood that within the scope of the appended claims, the disclosure of the present disclosure may be practiced otherwise than as specifically described herein. For example, elements and/or features of different illustrative embodiments may be combined with each other and/or substituted for each other within the scope of this disclosure and appended claims.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. An imaging system comprising:

a liquid discharge device; a heating device; and a cassette, wherein the cassette includes a holder configured to hold a recording medium; and a storage device configured to store heating-area data indicating a heating area of the recording medium to be heated before an image is printed on the recording medium, the heating-area data specifying an area in which an image can be printed on the recording medium, the heating-area data varying between cassettes, and the heating-area data indicating a different heating area for each type of cassette;

wherein the liquid discharge device includes a printing device configured to discharge liquid onto the recording medium held by the holder to print the image on the recording medium and a writing device configured to write liquid discharge region data to the storage device, the liquid discharge region data indicating a liquid discharge region of the recording medium onto which the liquid is discharged by the printing device, wherein the heating device includes a heater configured to heat the heating area of the recording medium, a reading device configured to read the heating-area data and the liquid discharge region data from the storage device, and a controller configured to cause the heater to heat in an area limited to the heating area indicated by the heating-area data on the recording medium held by the holder when the image is not yet printed on the recording medium and cause the heater to heat in an area limited to the liquid discharge region indicated by the liquid discharge region data on the recording medium held by the holder when the image has been printed on the recording medium.

2. The imaging system according to claim 1, wherein the heating area is a broadest area on the recording medium in which the image is printable.

3. The imaging system according to claim 1, wherein the heating-area data indicates a type of the cassette.

4. The imaging system according to claim 1, wherein the liquid discharge region data indicates a size of the liquid discharge region on the recording medium in which the image is printed.

5. The imaging system according to claim 1 wherein:

the controller detects a size of the cassette while the cassette is inserted into the heating device and before the image is printed onto the recording medium, and only the heating area of the cassette is heated before the image is printed.

6. The imaging system according to claim 1 wherein:

the controller detects a size of the cassette while the cassette is inserted into the heating device and after the image is printed onto the recording medium, and only the liquid discharge region around the cassette is heated after the image is printed.

* * * * *